US006615554B2

(12) United States Patent
Rupiper

(10) Patent No.: US 6,615,554 B2
(45) Date of Patent: Sep. 9, 2003

(54) HELICE PIER COUPLING SYSTEM USED FOR SOIL STABILIZATION

(76) Inventor: Stan Rupiper, P.O. Box 465, Tahoma, CA (US) 96142

( * ) Notice: Subject to any disclaimer, the term of this patent is extended or adjusted under 35 U.S.C. 154(b) by 0 days.

(21) Appl. No.: 09/941,920

(22) Filed: Aug. 30, 2001

(65) Prior Publication Data

US 2003/0041535 A1 Mar. 6, 2003

Related U.S. Application Data

(60) Provisional application No. 60/229,796, filed on Sep. 5, 2000.

(51) Int. Cl.[7] ..... E02D 5/80

(52) U.S. Cl. ..... 52/157; 52/165; 405/252.1

(58) Field of Search ..... 52/155, 157, 165, 52/169.13; 405/259.1, 252.1, 253, 250, 251, 241, 244; 175/323, 394; 403/305, 306

(56) References Cited

U.S. PATENT DOCUMENTS

| | | | | | |
|---|---|---|---|---|---|
| 88,891 | A | * | 4/1869 | McMahen | 175/394 X |
| 108,814 | A | * | 11/1870 | Moseley | 52/157 X |
| 137,744 | A | * | 4/1873 | West | 175/323 |
| 505,811 | A | * | 10/1893 | Brown | 52/157 X |
| 1,109,020 | A | * | 9/1914 | Skiff et al. | 52/157 |
| 2,729,067 | A | * | 1/1956 | Patterson | 175/394 X |
| 2,790,623 | A | * | 4/1957 | Pate et al. | 175/394 X |
| 3,710,523 | A | * | 1/1973 | Taylor | 52/157 |
| 4,290,245 | A | * | 9/1981 | Pardue et al. | 52/157 |
| 4,821,818 | A | * | 4/1989 | Mefferd | 175/323 |
| 5,904,447 | A | * | 5/1999 | Sutton et al. | 405/263 |
| 5,919,005 | A | * | 7/1999 | Rupiper | 405/244 |
| 5,934,836 | A | * | 8/1999 | Rupiper et al. | 405/244 |

* cited by examiner

*Primary Examiner*—Laura A. Callo
(74) *Attorney, Agent, or Firm*—Edwin H. Crabtree; Ramon L. Pizarro; Donald W. Margolis

(57) ABSTRACT

A helice pier coupling system used for used for soil stabilization, supporting building structures and similar applications. The coupling system provides a way of adding one or more pier shaft extensions to a helice pier shaft of a helice pier for extending the length of the pier. The pier shafts may have lengths of 5 feet or greater. The coupling system includes a first helice pier. The first helice pier having diagonal cuts at a lower first end and an upper second end of a pier shaft. The lower first end of the pier shaft can be used as a lead point when the pier shaft is driven into the soil surface. The upper second end of the pier shaft can be used with a shaft coupling for engaging a lower first end, having a mating diagonal cut, of a pier shaft of a second helice pier or the pier shaft extension. The first helice pier includes one or more helice plates.

20 Claims, 1 Drawing Sheet

HELICE PIER COUPLING SYSTEM USED FOR SOIL STABILIZATION

This application is based on an earlier filed provisional patent application having the same title and filed on Sep. 5, 2000, Ser. No. 60/229,796.

BACKGROUND OF THE INVENTION (a) Field of the Invention

This invention relates to a ground anchor device used for soil stabilization and supporting building structures and more particularly, but not by way of limitation, to a helice pier with a coupling system for adding one or more pier shaft extensions and coupling a first helice pier with a second helice pier.

(b) Discussion of Prior Art

Heretofore, there have been a variety of ground anchor devices used for soil stabilization. In particular, U.S. Pat. Nos. 5,904,447, 5,919,005 and 5,934,836 to Stan Rupiper et al. disclose recent anchor devices using helical piers for stabilizing soil, securing building foundations and other structures. Also, the patents cited during the prosecution of the above patents are incorporated herein by reference.

None of the prior art ground anchor devices described in the cited patent references provide the unique features, structure, and advantages of the subject helice pier coupling system as described herein.

SUMMARY OF THE INVENTION

In view of the foregoing, it is a primary objective of the subject invention to provide a better way of coupling together two or more helice piers. The helice piers used for soil stabilization, supporting building structures and similar applications.

Another object of the coupling system is to provide a way of adding one or more pier shaft extensions to a helice pier shaft of a helice pier for extending the length of the pier. The pier shafts may have lengths of 5 feet or greater. By adding additional pier shaft extensions, the overall length of the helice pier can be increased to 20 to 30 feet and greater as the pier is advanced into a ground surface.

Yet another object of the invention is the pier shaft includes diagonal cuts at opposite ends. A diagonal cut at a lower end of the pier shaft can be used as a lead point when driving the helice pier into the ground surface. An upper diagonal cut end can be used with a coupling for mating with a similar diagonal cut end of a second helice pier shaft or a pier shaft extension.

Still another object of the coupling system is to include alternate helice plates, disposed along the length of the pier shaft, each having a cutting edge rotated 180 degrees. This feature provides for smooth rotation and non-wobbling of the helice pier as it is driven into the ground surface.

The coupling system includes a first helice pier. The first helice pier having diagonal cuts at a lower first end and an upper second end of a first pier shaft. The lower first end of the pier shaft can be used as a lead point when the pier shaft is driven into the soil surface. The upper second end of the first pier can be used with a shaft coupling for engaging a lower first end, having a mating diagonal cut, of a second pier shaft of a second helice pier. The shaft coupling can be welded to the upper second end of the first pier shaft.

The lower first end of the second pier shaft can be bolted to the shaft coupling using one or more bolts. The shaft coupling and the lower first end of the second pier shaft include bolt head slots therein. The bolt head slots are used for receiving a bolt head and a portion of a threaded bolt pin of a connecting bolt.

Also, the first and second pier shafts can include one or more helice plates disposed along the length of each shaft. The helice plates can be permanently secured to the shaft and/or the helice plates can include sliding collars for sliding the helice plates to selected positions along the length of the shaft. The leading cutting edge of each helice plate is designed so that the cutting edge of alternating plates, along the length of the shaft, is rotated at various degrees up to 180 degrees. Also, the alternating plates can be positioned at various angles to each other to suit different types of field conditions.

These and other objects of the present invention will become apparent to those familiar with ground and soil stabilization devices and helical piers used in stabilizing soil, building foundations, concrete slabs and other structures when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DESCRIPTION OF THE PREFERRED EMBODIMENTS

Figure 1:
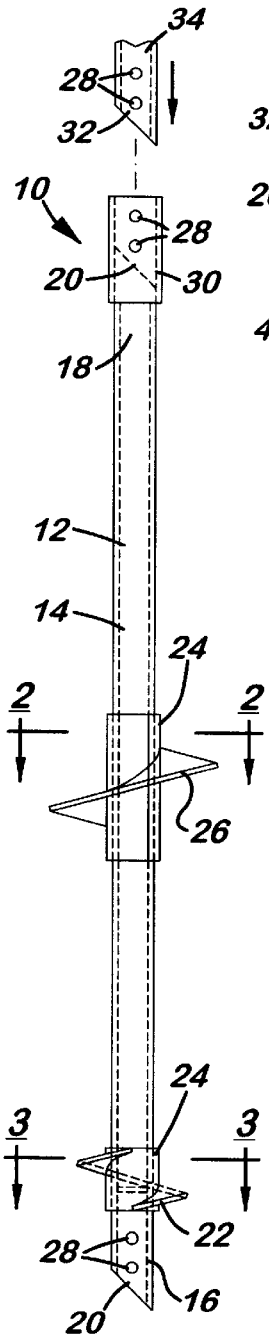
FIG. 1 is a front view of the helice pier coupling system with a first helice pier and a lower end of a pier shaft extension. The helice pier and the pier shaft extension are used for driving into a ground surface 10 to 20 feet and greater.

In FIG. 1, a perspective view of the helice pier coupling system is shown having a general reference numeral 10. The coupling system 10 includes a first helice pier 12 having a pier shaft 14 with a lower first end 16 and an upper second end 18. The first and second ends 16 and 18 include a diagonal cut 20. The diagonal cut 20 can be cut at an angle of 5 to 60 degrees perpendicular to a center line along a length of the pier shaft 14. In this drawing, the lower first end 16 with the diagonal cut 20 can be used as a lead point when the first helice pier 12 is driven into a ground surface.

Also, the first helice pier 12 includes a lower helice plate 22 with a plate collar 24 and an upper helice plate 26 with an adjustable plate collar 24. While the drawing in FIG. 1 shows two helice plates 22 and 26, is should be kept in mind any number of helice plates can be disposed along the length of the pier shaft 14. The adjustable plate collar 24 allows the helice plates 22 and 26 to be slide or adjusted along the length of the pier shaft 14 to a selected position prior to the plates are secured thereto.

Further, the first helice pier 12 includes one or more bolt holes 28 in a shaft coupling 30. Also, similar bolt holes 28 are shown in a shaft coupling 30. Also, similar bolt holes 28 are shown in the lower first end 16. The bolt holes 28 are used, for example, in connecting the upper second end 18 with the coupling 30 to a lower first end 32 of a pipe shaft extension 34. A lower portion of the pier shaft extension 34 is shown in FIG. 1. The extension 34 also includes bolt holes 28.

While the pier shaft extension 34 is shown in this drawing, it should be kept in mind that any number of pier shaft extensions and/or a second helice pier with pier shaft and one or more helice plates can be coupled together end to end. By using the subject helice pier coupling system 10 for forming a string of connected pier shafts, depths of 20 to 30 feet and greater can be achieved for providing soil stabilization and supporting different types of structure.

Figure 2:
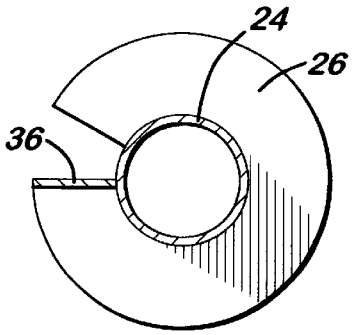
FIG. 2 is a top sectional view of a helice plate taken along lines 2—2 shown in FIG. 1.

In FIG. 2, a top sectional view of the upper helice plate 26 with plate collar 24 is shown taken along lines 2—2 shown in FIG. 1. The helice plates 22 and 26 can have diameters of 10 to 20 inches and greater and can have a round, an octoagonal and other geometric configurations. Note in this drawing, the upper helice plate 26 has a starting cutting edge 36 on the left side of the plate.

Figure 3:
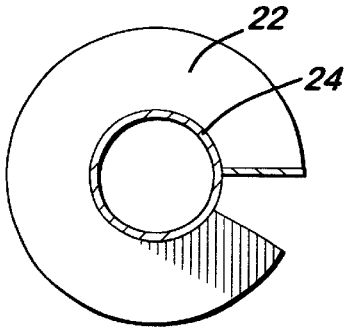
FIG. 3 is a top sectional view of another helice plate taken along lines 3—3 shown in FIG. 1.

In FIG. 3, a top sectional view of the lower helice plate 22 with plate collar 24 is shown taken along lines 3—3 shown in FIG. 1. In this drawing, the lower helice plate 22 has a starting cutting edge 38 on the right side of the plate and 180 degrees from the position of the cutting edge 36 of the upper helice plate 26. By alternating the position of the cutting edge of the helice plate, disposed one on top of the other and spaced along the length of the pier shaft 14, smooth rotation and non-wobbling of the helice pier 12 may be provided as it is driven into the ground surface. The plate collars 24 of the helice plates may be welded permanently to the pier shaft 14 or the collars may be adjustable and releasably attached along the length of the shaft.

Figure 4:
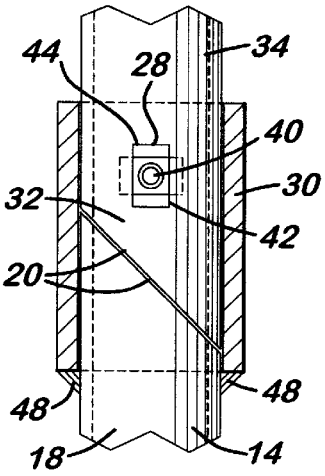
FIG. 4 is a front sectional view of a shaft coupling and a connecting bolt received in a bolt slot in a lower first end of a pier shaft extension.

In FIG. 4, a front sectional view of the shaft coupling 30 and the connecting bolt 40 are shown received in a bolt slot 42 in the lower first end 32 of the pier shaft extension 34. The bolt 40 includes a rectangular shaped bolt head 44 and a threaded bolt pin 46. In this drawing, the lower end of the coupling 30 is shown with a permanent weld 48 around the sides of the pier shaft 14. While the weld 48 is shown, it can be appreciated that if desired the coupling 30 could be connected to the upper second end 18 of the pier shaft 14 using a connecting bolt or similar coupling fastener.

Figure 5:
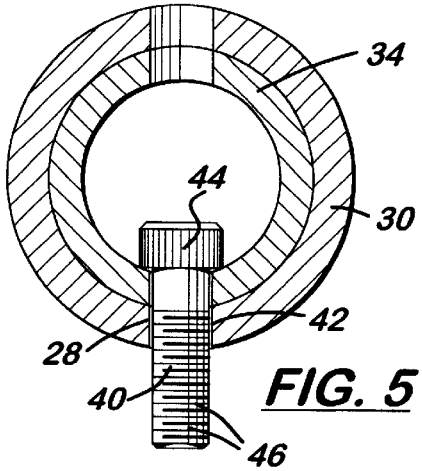
FIG. 5 is a top sectional view of the shaft coupling, the lower first end of the pier shaft extension and the connecting bolt.

In FIG. 5, a top sectional view of the shaft coupling 30 is shown. In this drawing, the rectangular bolt head 44 is shown received through the bolt slot 42 and then rotated 90 degrees for holding the bolt 40 therein. Obviously, when a bolt nut is threaded onto the threaded bolt pin 46, the lower first end 32 of the pier shaft extension 34 is secured to the shaft coupling 30 and secured to the upper second end 18 of the pier shaft 14. In this manner of coupling, using the shaft coupling 30 and the diagonal cuts 20, the ability to apply increased torque along the length of the pier shaft 14 and the pier shaft extension 34 is greatly improved when driving the helice pier 12 into the ground surface.

Figure 6:
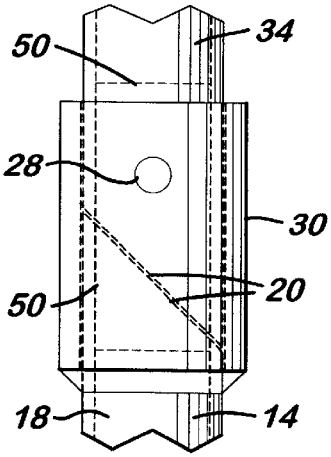
FIG. 6 is a front view of a shaft coupling with a connecting bar used to reinforce the coupling connection between the upper second end of the first helice pier and the lower first end of the pier shaft extension.

In FIG. 6, a front view of the shaft coupling 30 is shown. In this drawing, an internal connected bar 50 or pipe extension is used to reinforce the lower first end 32 of the pier shaft extension 34 when it is coupled to the upper second end 18 of the pier shaft 14. The connecting bar 50 is shown in dotted lines.

Figure 7:
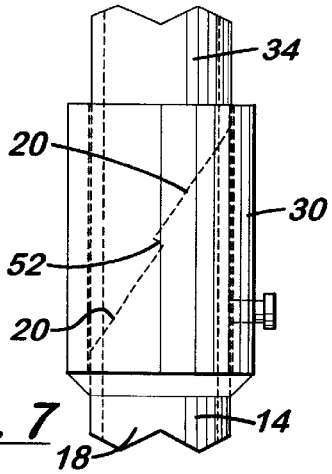
FIG. 7 is a front view of another embodiment of the connection between the upper second end of the first helice pier and the lower first end of the pier shaft extension wherein a diagonal cut includes a catch along the length of the cut.

In FIG. 7, a front view of another embodiment of the diagonal cut 20 is shown. In this type of connection between the upper second end 18 of the pier shaft 14 and the lower first end 32 of the pier shaft extension 34, the diagonal cut 20 includes a catch 52 along the length of the two diagonal cuts 20. The catch 52 provides for an improved coupling between the two angled diagonal cuts in the lower first end 32 of the pier shaft extension 34 and the upper second end of the pier shaft 14.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A helice pier coupling system used with helice piers for soil stabilization, building structures and similar applications, said coupling system comprising:

a first helice pier with a pier shaft, the pier shaft having a lower first end and an upper second end, the upper second end having a diagonal cut at an angle to a length of the pier shaft;

a pier shaft coupling for engaging and attaching the upper second end of the pier shaft of said first helice pier to a lower first end of a pier shaft extension, the lower first end of said pier shaft extension having a diagonal cut at an angle from a length of said pier shaft extension for mating with the diagonal cut of the upper second end of the pier shaft of said first helice pier; and at least one helice plate with shaft collar, said shaft collar attached to the pier shaft along a length thereof.

2. The coupling system as described in claim 1 further including an upper helice plate with shaft collar and cutting edge and a lower helice plate with shaft collar and cutting edge, said shaft collars attached along the length of the pier shaft, the cutting edge of said upper helice plate rotated at an angle from the cutting edge of said lower helice plate for providing smooth rotation of said first helice pier.

3. The coupling system as described in claim 1 wherein the lower end of said pier shaft extension is attached to said coupling using a removable bolt received in bolt head slots in said coupling and in the lower end of said pier shaft extension.

4. The coupling system as described in claim 1 wherein the lower first end of said pier shaft has a diagonal cut at an angle to the length of said pier shaft, the lower first end of the pier shaft of said first helice pier used as a lead point when the pier shaft is driven into the soil surface.

5. A helice pier coupling system used with helice piers for soil stabilization, building structures and similar applications, said coupling system comprising:

a first helice pier with a pier shaft, the pier shaft having a lower first end and an upper second end, the upper second end having a diagonal cut at an angle to a length of the pier shaft;

a second helice pier with a pier shaft, the pier shaft having a lower first end and an upper second end, the lower first end having a diagonal cut at an angle to a length of the pier shaft;

a pier shaft coupling for engaging and attaching the upper second end of the pier shaft of said first helice pier to the lower first end of the pier shaft of said second helice pier, the diagonal cut of the upper second end of the pier shaft of said first helice pier mating with the diagonal cut of the lower second end of the pier shaft of said second helice pier;

a first helice plate with shaft collar, said shaft collar attached to the pier shaft of said first helice pier along a length thereof; and a second helice plate with shaft collar, said shaft collar attached to the pier shaft of said second helice pier along a length thereof.

6. The coupling system as described in claim 5 further including a first upper helice plate with shaft collar and cutting edge and a first lower helice plate with shaft collar and cutting edge, said shaft collars attached along the length of the pier shaft of said first helice pier, the cutting edge of said first upper helice plate rotated at an angle from the cutting edge of said first lower helice plate for providing smooth rotation of said first helice pier.

7. The coupling system as described in claim 6 wherein the cutting edge of said first upper helice plate is rotated at an angle up to 180 degrees from the cutting edge of said first lower helice plate for providing a smooth rotation of said first helice pier.

8. The coupling system as described in claim 6 further including a second upper helice plate with shaft collar and cutting edge and a second lower helice plate with shaft collar and cutting edge, said shaft collars attached along the length of the pier shaft of said second helice pier, the cutting edge of said second upper helice plate rotated at an angle from the cutting edge of said second lower helice plate for providing smooth rotation of said second helice pier.

9. The coupling system as described in claim 8 wherein the cutting edge of said second upper helice plate is rotated at an angle up to 180 degrees from the cutting edge of said second lower helice plate for providing a smooth rotation of said second helice pier.

10. The coupling system as described in claim 5 wherein the lower end of the pier shaft of said second helice pier is attached to said coupling using a removable bolt received in bolt head slots in said coupling and in the lower first end of the pier shaft of said second helice pier.

11. The coupling system as described in claim 5 wherein the lower first end of the pier shaft of said first helice pier has a diagonal cut at an angle to the length of the pier shaft, the lower first end of the pier shaft of said first helice pier used as a lead point when the pier shaft is driven into the soil surface.

12. A helice pier coupling system used with helice piers for soil stabilization, building structures and similar applications, said coupling system comprising:

a first helice pier with a pier shaft, the pier shaft having a lower first end and an upper second end, the upper second end having a diagonal cut at an angle in a range of 5 to 60 degrees perpendicular to a center line along a length of the pier shaft;

a pier shaft coupling for engaging and attaching the upper second end of the pier shaft of said first helice pier to a lower first end of a pier shaft extension, the lower first end of said pier shaft extension having a diagonal cut at an angle from a length of said pier shaft extension for mating with the diagonal cut of the upper second end of the pier shaft of said first helice pier; and at least one helice plate with adjustable shaft collar, said shaft collar adjustably attached to the pier shaft along a length thereof.

13. The coupling system as described in claim 12 further including an upper helice plate with an adjustable shaft collar and cutting edge and a lower helice plate with adjustable shaft collar and cutting edge, said adjustable shaft collars adjustable along a length of the pier shaft extension, the cutting edge of said upper helice plate rotated at an angle from the cutting edge of said lower helice plate for providing smooth rotation of said first helice pier.

14. The coupling system as described in claim 13 wherein the cutting edge of said upper helice plate is rotated at an angle up to 180 degrees from the cutting edge of said lower helice plate for providing a smooth rotation of said first helice pier.

15. The coupling system as described in claim 12 wherein the lower end of said pier shaft extension is attached to said coupling using a removable bolt received in bolt head slots in said coupling and in the lower end of said pier shaft extension.

16. The coupling system as described in claim 12 wherein the lower first end of said pier shaft has a diagonal cut at an angle in a range of 5 to 60 degrees perpendicular to a center line along the length of said pier shaft, the lower first end of the pier shaft of said first helice pier used as a lead point when the pier shaft is driven into the soil surface.

17. The coupling system as described in claim 12 wherein the diagonal cut in the upper second end of the pier shaft and the diagonal cut in the lower first end of said pier shaft extension includes a catch therein for providing an improved coupling between the pier shaft and the pier shaft extension.

18. The coupling system as described in claim 12 further including a connecting bar received in a portion of the upper second end of the pier shaft and in a portion of the lower first end of said pier shaft extension for reinforcing the coupling between the pier shaft and the pier shaft extension.

19. The coupling system as described in claim 12 wherein said pier shaft extension is a second helice pier, said second helice pier having a pier shaft and at least one helice plate with adjustable collar.

20. The coupling system as described in claim 19 wherein said second helice pier includes an upper helice plate with an adjustable shaft collar and cutting edge and a lower helice plate with adjustable shaft collar and cutting edge, said adjustable shaft collars adjustable along a length of the pier shaft of said second helice pier, the cutting edge of said upper helice plate rotated at an angle from the cutting edge of said lower helice plate for providing smooth rotation of said second helice pier.

* * * * *